United States Patent [19]

Vanderwal, Jr. et al.

[11] Patent Number: 4,512,116

[45] Date of Patent: Apr. 23, 1985

[54] FEED-UP MEANS FOR EXPANDABLE WORK ENGAGING MEMBERS

[75] Inventors: Frank E. Vanderwal, Jr., Frontenac; James K. Davis, Cedar Hill, both of Mo.

[73] Assignee: Sunnen Products Company, St. Louis, Mo.

[21] Appl. No.: 502,146

[22] Filed: Jun. 8, 1983

[51] Int. Cl.[3] ..... B24B 33/02

[52] U.S. Cl. ..... 51/347; 51/351; 51/331; 72/122; 310/67 R; 82/59; 408/152; 299/80

[58] Field of Search ..... 51/34 H, 90, 165.93, 51/330, 331, 338–348, 350, 351; 82/59; 175/173, 202; 299/80; 408/12, 152, 153, 154, 161; 83/191; 310/67 R; 72/120, 122

[56] References Cited

U.S. PATENT DOCUMENTS

| | | | |
|---|---|---|---|
| 1,441,242 | 1/1923 | Robinson | 51/90 |
| 2,301,111 | 11/1942 | Cuppers et al. | 51/344 |
| 2,334,838 | 11/1943 | Prange | 51/351 X |
| 3,106,114 | 10/1963 | Cogan | 72/122 X |
| 3,237,487 | 3/1966 | Widmer et al. | 408/152 |
| 3,403,483 | 10/1968 | Gjertsen et al. | 51/347 |
| 3,404,490 | 10/1968 | Estabrook | 51/165.93 |
| 3,800,482 | 4/1974 | Sunnen | 51/351 X |

*Primary Examiner*—Robert P. Olszewski

*Attorney, Agent, or Firm*—Haverstock, Garrett & Roberts

[57] ABSTRACT

An improved drive chain for a machine tool such as honing device comprising a machine tool with at least one radially movable work engaging assembly thereon, a power train operatively connected to the honing device to rotate same, and a feed motor positioned in the power chain and rotatable therewith, the feed motor being operatively connected to a power source and to the machine tool whereby energization of the feed motor changes the radial positions of the work engaging assemblies on the honing device. The invention also resides in the rotatable power chain with a motor mounted therein, novel electric contacts for introducing energy to the rotating motor and a novel control circuit for supplying power from the power source to the feed motor.

37 Claims, 11 Drawing Figures

HONE FEED CIRCUIT

FEED-UP MEANS FOR EXPANDABLE WORK ENGAGING MEMBERS

FIELD OF THE INVENTION

The present invention relates to an improved feed-up means for expandable and contractable work engaging assemblies such as expandable and contractable honing mandrels and the like.

DESCRIPTION OF RELATED ART

There are in existence and known many different devices for expanding and contracting work engaging assemblies such as honing mandrels. The known devices have included means for maintaining pressure on the work engaging members such as on honing stones and shoes against a bore being honed in order to produce and maintain the desired honing pressure. The known devices have included various different kinds of wedge means which bear against and support the work engaging members, see for examples Sunnen U.S. Pat. Nos. 1,989,831, 2,117,525, 2,350,969, 2,376,850, 2,376,851, 2,421,470, and 2,532,682, they have included other types of devices including threaded means with cams for expanding and contracting work engaging members as shown in Sunnen U.S. Pat. No. 3,378,962, and rack and pinion feed-up devices as shown in Sunnen U.S. Pat. Nos. Re. 18,763, 1,929,613, 1,946,041, 1,982,836, 2,002,649, 2,020,589, 2,040,281 and 3,216,155. For the most part the known wedge devices, threaded cam devices, and rack and pinion devices have been controlled by means that extend into the honing or other machine, and to some extent this has limited the length of bore that can be operated on or honed thereby. Another prior art construction includes a planetary gear arrangement as shown in pending Sunnen et al U.S. patent application Ser. No. 275,748.

The known devices have been suitable for many purposes and applications and they have been widely used. However, the known devices suffer from certain limitations and shortcomings especially when used in larger diameter workpieces. For example, the mechanical wedge and threaded cam feed-up devices are relatively limited as to the range of their possible adjustment, they usually are limited to making adjustments on one side or on opposite sides of a work engaging assembly or mandrel and these devices often produce eccentricity problems and associated errors which vary with the range of their adjustment, the wedge members in such devices are not generally centered on the axes of the mandrels and this can cause problems and inaccuracies, and mechanical wedges can in such devices, including in honing devices also introduce inaccuracies due to temperature changes that cause unequal expansion and contraction of the wedge members as compared to the members they engage, support and adjust. The latter problem is usually aggravated as the length of the wedge members increases. The use of wedges is also generally limited to operations, such as honing operations, in relatively short bores. Many of the same limitations and shortcomings are present in threaded cam adjustment devices such as the device disclosed in U.S. Pat. No. 3,378,962.

Rack and pinion expansion and contraction means have presented problems in the means for supplying power for operating them, and in those devices where the feed-up expansion and contraction power is fed from means a machine on which the work engaging assembly is mounted, the means employed have been complicated, difficult to control and difficult to couple to the work engaging assembly or mandrel. Because of this the planetary gear arrangement disclosed in the referenced pending application was devised and found to be suitable for some applications, but planetary gear devices are relatively complicated structurally and therefore relatively expensive to make, and some of the gears included in such devices, including especially some of the smaller gears, must rotate for extended periods at relatively high speeds and under loads that require that they be made to be larger and stronger than would be required for the feed forces alone in order to avoid relatively frequent maintenance and extended down time. The maintenance of such devices is also relatively difficult to do and is time consuming to perform because of the complexity and number of parts involved, and there is a tendency for one failure to cause a series of related failures. There is also an undesirable inertia problem with planetary gear constructions that causes the smaller planetary gears to rotate with greater resistance for one direction of rotation of the drive train than for rotation in the opposite direction thereof. This means an output torque will be greater or less depending on which direction it is rotating in.

SUMMARY OF THE INVENTION

The present construction has important advantages over the known constructions and overcomes many of the disadvantages and shortcomings mentioned above. The present construction includes a rotatable drive train assembly that is connected to a source of power to rotate it at one end and has a work engaging assembly at the opposite end. The drive train has a motor mounted therein with a motor shaft that is rotatable under very controllable conditions. The internal motor shaft may be used for expanding, contracting and loading a tool assembly such as a honing mandrel mounted on and made a part of the drive train. The present device may optionally include a speed reducer such as an harmonic speed reducer which couples the motor shaft to the feed-up means in the work engaging assembly or honing mandrel. In the present construction the motor and the optional speed reducer associated therewith are mounted in the drive train assembly to rotate at the same speed as the work engaging assembly, and the motor is controlled and energized to cause it to operate directly or througn the speed reducer to produce the desired expansion, contraction and loading of the work engaging members on the work engaging assembly. The present construction is relatively simple structurally as compared to the known devices discussed above including the known planetary gear arrangement disclosed in the co-pending application Ser. No. 275,748, it is a more balanced construction, and the present construction is less susceptible to wear, is easier and less time consuming to repair and maintain, it has fewer parts and is much less complicated and less expensive to make than devices such as planetary gear feed up devices. The present construction has the additional advantage of providing similar speed and torque characteristics for either direction of rotation of the rotating motor whereas planetary gear devices produce significant differences in these characteristics because of the effect on them due to the rotation of the drive train. The present device also provides a wide range of possible adjustment and can achieve desired mandrel loading and unloading conditions including providing improved run out characteristics. The rotating motor in the present construction can also be controlled to produce a wider range of operating conditions than are available from the known devices.

It is therefore a principal object of the present invention to provide simpler more accurately controllable and more maintenance free means for expanding, contracting and loading the work engaging elements such as the radially movable work engaging elements on a work engaging assembly.

Another object is to provide means to produce more accurate honing and other machine tool operations.

Another object is to be able to generate an internal profile on a workpiece surface by controlled expansion and retraction of work engaging elements as they traverse the workpiece surface.

Another object is to provide accurately controllable expansion, contraction and loading means which have application to honing, boring, grinding, roll forming and other like machine tool devices.

Another object is to minimize the maintenance and down time of devices for coupling rotatable work engaging structures such as honing mandrels to a honing machine.

Another object is to enable more accurate honing of relatively long bores.

Another object is to provide improved and more versatile means to control the feed up, contraction and loading of expandable rotatable work engaging assemblies.

Another object is to provide means to more accurately control the feed rate and pressure of a work engaging assembly such as a honing mandrel or like device in order to produce optimum operating conditions including optimum stock removal rates and optimum wear of the work engaging members.

Another object is to provide a more nearly balanced rotatable drive train for an expandable and contractable work engaging device such as a honing mandrel including for the associated control means therefor.

Another object is to reduce the number of parts required in a device used to radially expand and contract the work engaging members on a honing mandrel or like device.

Another object is to provide means controllable to produce improved run out characteristics in a honing or like operation and improved surface characteristics of parts that are honed.

Another object is to simplify the replacement of the wear parts and reduce machine down time for expandable and contractaole honing mandrels and like devices.

Another object is to provide means to accurately and continuously indicate to the operator of a work engaging device such as a honing device the instantaneous load present on the work engaging members.

Another object is to provide safety means on a honing device which limit the maximum torque that can be applied thereto.

Another object is to make the operation of a honing or like machine safer, more automatic and more accurate.

These and other objects and advantages of the present invention will become apparent after considering the following detailed specification of preferred embodiments thereof in conjunction with the accompanying drawings wherein:

DESCRIPTION OF THE PREFERRED EMBODIMENTS

Figure 1:
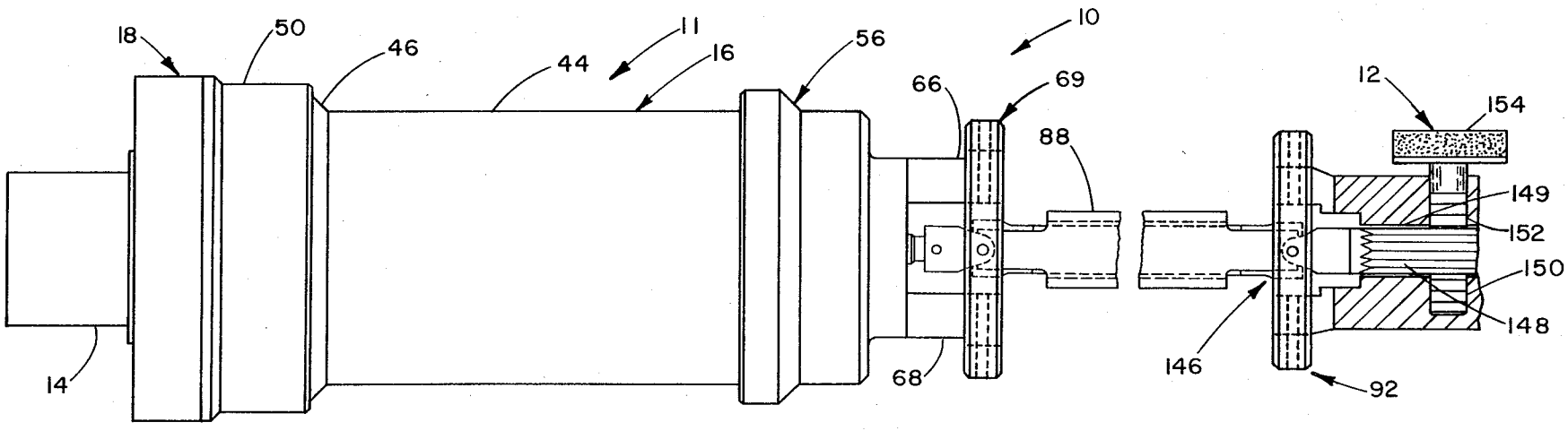
FIG. 1 is a side view of a drive train for a rotatable work engaging assembly such as a honing mandrel, said drive train including motor means for controlling expansion, contraction and loading of the work engaging parts.
Figure 3:
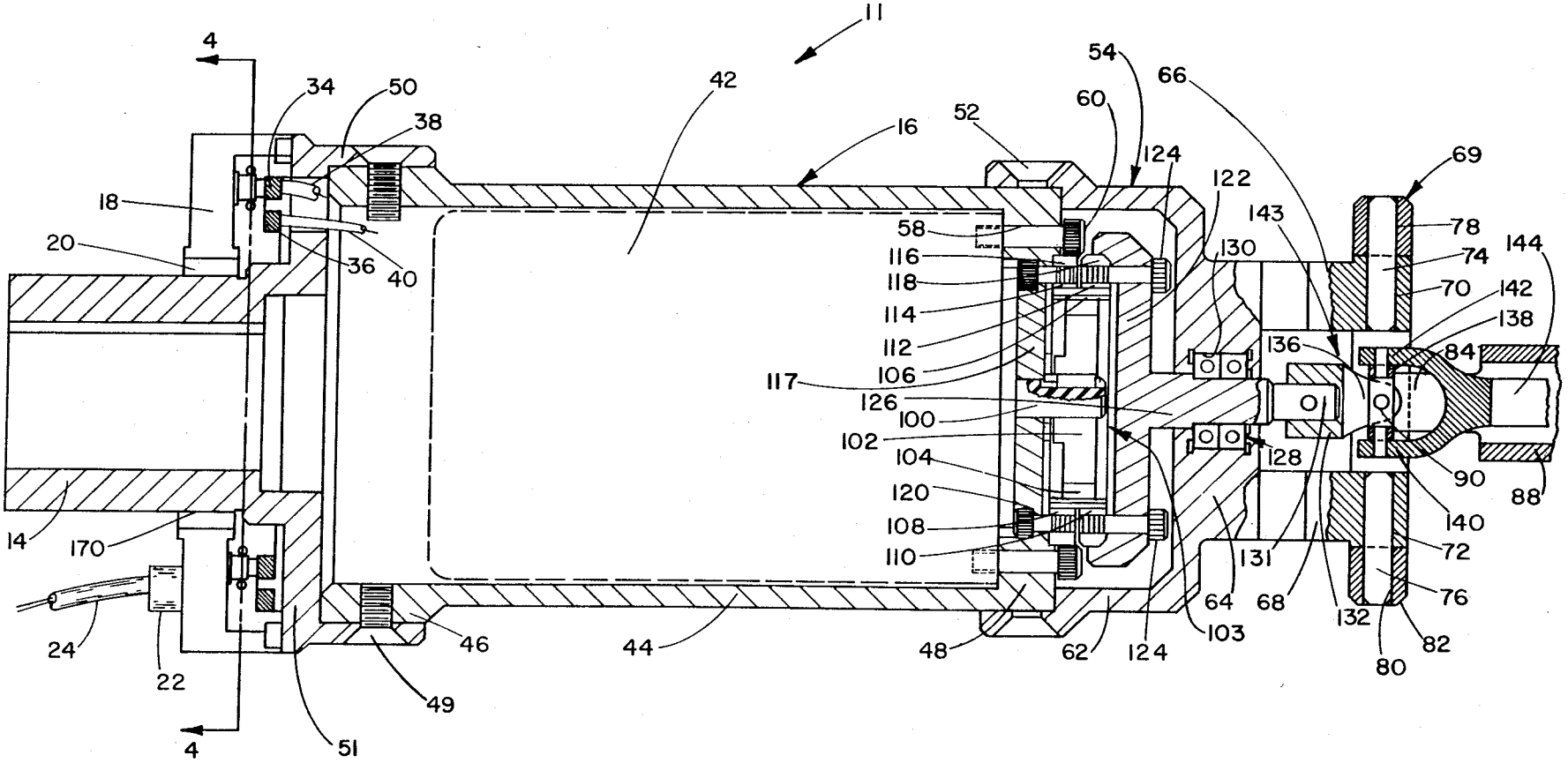
FIG. 3 is an enlarged cross-sectional view taken on the axis of the motor controlled feed up portion of the drive train shown in FIG. 2.

Referring to the drawings more particularly by reference numbers, number 10 in FIG. 1 refers to a drive train including motor operated means 11 for controlling the expansion, contraction and loading of the work engaging members of a rotatable work engaging assembly such as honing mandrel 12. In the construction as shown, the main source of power for rotating, supporting, and aligning the drive train 10 is applied to input portion 14 of a rotatable structure 16 that has a bearing relationship with a non-rotatable structure 18 by means of journal members or bearings 20 (FIG. 3) mounted therein. The non-rotatable structure 18 provides no structural support or alignment for the drive train 10 but is included to make the electrical connections to motor means included in the drive train 10 as will be explained. The structure 18 has an electric cable connection thereto which includes electric fitting 22 and cable 24 connected to a control circuit which includes a source of electric energy as will be described in connection with FIGS. 6 and 7. The electric wires in the cable 24 have connections to brushes 26, 28, 30, and 32 (FIG. 4) mounted on the non-rotatable structure 18, which brushes make sliding contact with annular slip rings 34 and 36 (FIG. 3) mounted on the rotatable drive train 10. The slip rings 34 and 36 have respective leads 38 and 40 connected thereto, and the opposite ends of the leads are connected to an electric motor sometimes also called rotating feed motor 42 mounted in elongated rotatable tubular housing 44. Additional slip ring/brush connections can also be provided, if desired, for connecting to a tachometer or rotary resolver feed back to a control.

The tubular housing 44 is shown having an annular outwardly extending end flange 46 on one end and an inwardly extending flange 48 on the opposite end, both of which flanges have apertures therethrough for receiving attachment threaded members such as bolts 49 used for attaching annular portion 50 of member 51 which is also part of the input portion 14. The member 51 is the portion of the device that has the annular slip rings 34 and 36 attached thereto as shown. Each of the slip rings 34 and 36 is slidably engagable by two of the brushes 26, 28, 30 and 32 (FIG. 4) which are mounted on the non-rotatable structure 18 and provide an electrical path for energy from the control circuit to the motor 42 to control its speed and direction of rotation. The details of the circuitry for operating the drive motor 42 will be described more in detail in connection with FIGS. 6 and 7 as aforesaid.

The inwardly extending housing flange 48 at the opposite end of the motor housing 44 is attached by other bolts 52 to another annular member 54 which extends from the adjacent end of the housing 44. The motor housing 44 is also provided with end wall 117 containing other bolt openings 58 through which bolts 60 extend for threaded attachment of the motor 42 thereto. The member 54 extends from the housing 44 and includes a portion 64 to which are attached spaced endwardly extending legs 66 and 68 which form parts of universal connection assembly 69. The legs 66 and 68 have respective radial bores 70 and 72 formed therethrough for receiving respective pivot pins 74 and 76 which also extend through opposed bores 78 and 80 in an annular member 82 also part of the universal connection assembly 69. The annular member 82 is similarly pivotally connected to spaced endwardly extending leg portions 84 (only one being shown in FIG. 3) which are connected to one end of a tubular drive member 88 by other pins 90. The opposite end of the drive tube 88 is connected by a similar but preferably smaller diameter universal connection assembly 92 (FIG. 1) which is also connected to one end of the honing head or mandrel 12. The universal assembly 92 is usually made to be somewhat smaller in diameter so that it can move into a bore being honed without coming in contact with the bore or with the workpiece. When force is applied to rotate the input end portion 14 of the feed train 10, the assembly 11 as well as the honing mandrel 12 rotate as a unit, power being transmitted to the mandrel through the drive tube 88, and in the construction shown in FIGS. 1–3, through the universal connection assemblies 69 and 92 at opposite ends thereof. During rotation of the drive train 10, controlled electric energy is supplied to the rotating feed motor 42 to control its speed and direction of rotation and therefore also expansion and contraction of the work engaging members on the mandrel operatively connected thereto including controlling the amount of force applied by the work engaging members against a work surface.

The drive tube 88 is made tubular in order to provide a passageway therethrough to accommodate the means for adjusting the diameter and loading of the work engaging members on the mandrel 12. The force for accomplishing this is provided by the feed motor 42 which is shown having an output shaft 100 connected to rotate a rotatable disk member 102 which is part of an optional gear reducer assembly 103 which may be of known construction such as disclosed in U.S. Pat. Nos. 3,435,706 and 3,461,997. The disk member 102 has an eccentric peripheral cam portion 104 which slidably engages the inner surface of an annular member 106 formed of a hard but relatively flexible material. The annular flexible member 106 has a smooth inner surface which makes sliding contact with the cam portion 104 and it has formed on its outer surface adjacent sets of gear teeth 108 and 110 (FIG. 5) which respectively engage teeth 112 and 114 on the inner surfaces of annular members 116 and 118. In a typical situation there are two more teeth on the member 116 than on the member 118. This causes relative rotation between the two gear members 116 and 118 as the cam 104 is caused to rotate. The annular member 116 is fixedly attached to one side of the motor housing end wall 117 by a plurality of threaded members or bolts 120 and the annular member 118 is attached to a rotatable output member 122 by a plurality of other bolts 124. The member 122 has an output portion 126 which is journaled by bearing means 128 in an opening 130 in the wall portion 64 of the member 54. During operation of the subject device the feed motor 42 is selectively energized to rotate in either opposite direction and at a desired speed as will be explained. In one direction of rotation of the motor shaft 100 relative motion will be produced between the annular members 116 and 118, and between the wall 117 and the member 122, to rotate the output portion 126 of the speed reducer assembly 103 in one direction. When the motor 42 is energized to rotate in the opposite direction the output portion 126 will rotate in the opposite direction.

The rotatable portion 126 has a connected end 131 which is attached to a forked member 132 that has spaced arm portions one being shown at 136. The arms 136 are pivotally connected to opposite sides of an annular member 138 which is also pivotally connected at other locations thereon to other spaced arms 140 and 142 to form a relatively small universal connection assembly 143 which is attached to one end of a feed rod member 144 which extends through the drive tube 88. The opposite end of the feed rod 144 is connected to another relatively small diameter universal connection assembly 146 (FIG. 1) similar to the universal connection assembly 143, which pivotally connects the feed rod 144 to one end of a pinion gear 148 that extends through a bore 149 in the honing mandrel 12. It is preferred to have the centers of rotation of the universal connection assemblies 69 and 143 and the universal connection assemblies 92 and 146 be coincident for the best and freest operating condition.

The pinion gear 148 is located in the longitudinally extending bore 149 in the honing mandrel 12 and engages spaced sets of rack gears such as rack gear 150 which is part of a honing stone assembly 154. The pinion gear 148 may engage similar sets of rack gears on two or more work engaging assemblies as required including in some mandrel constructions rack gears on honing stone assemblies and rack gears on guide or backing assemblies. When the feed motor 42 is operated in one direction it causes the output portions 126 and 131 to rotate in one direction relative to housing structure 16 and in so doing it also rotates the pinion gear 148 in one direction to radially advance, or retract, the work engaging assemblies to increase, or decrease, the honing diameter of the mandrel 12. It is important to be able to accurately control the expansion and contraction of the work engaging assemblies including the rate of movement thereof in order to be able to move the mandrel into a bore or work surface, expand it outwardly into engagement with the work surface, maintain a load on the work engaging members against the work surface while the mandrel is rotating in the work surface to produce the desired honing action, and thereafter when the bore has been honed to some desired diameter to controllably reduce the pressure of the work engaging members against the workpiece to produce a desired surface finish during run out and to be able to retract the work engaging members so that the mandrel can be removed from the workpiece without damage to the mandrel or to the work surface.

Figure 2:
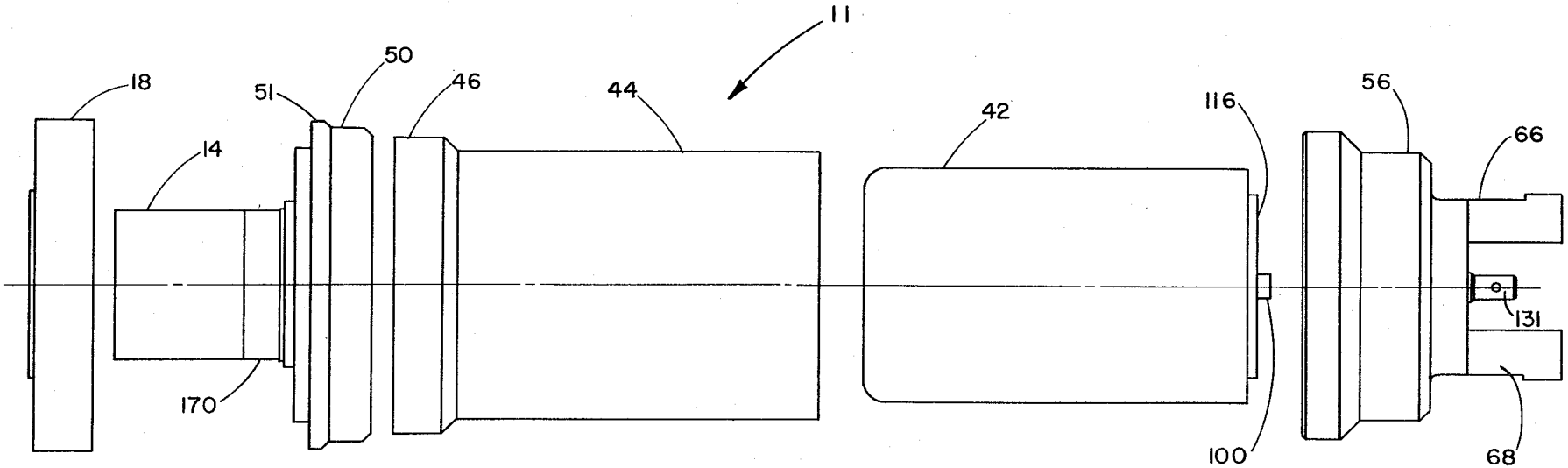
FIG. 2 is an exploded side elevational view of the portion of the drive train shown in FIG. 1 that is used to control the expansion, contraction and loading of the work engaging parts.

FIG. 2 is in exploded view showing the relationship between the various components included in the assembly 11 including between the stationary or non-rotatable structure 18, the input portion 14, the annular portion 50 of member 51 to which the slip rings 34 and 36 are attached, the tubular motor housing 44, the motor 42 mounted therein and attached to the wall 117 as aforesaid (see FIG. 3), the motor shaft 100, and the harmonic gear reducer assembly 103 which is mounted in the member 54 to which the legs 66 and 68 of the universal connection assembly 69 are attached.

Figure 4:
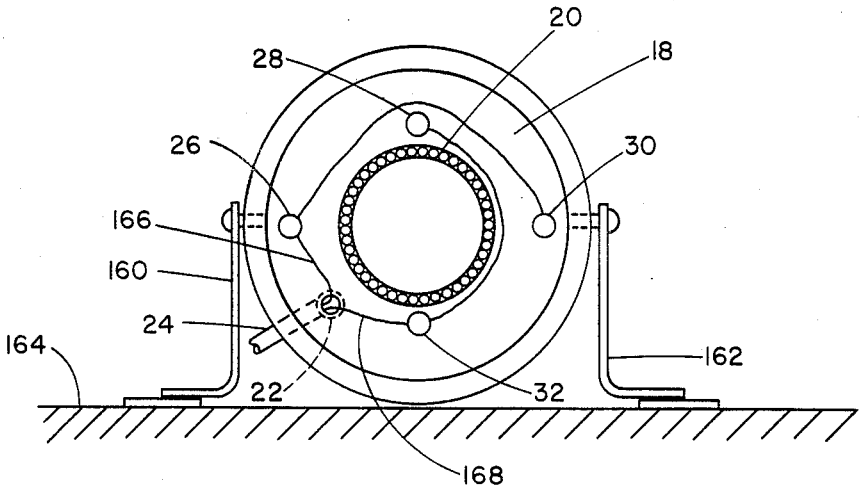
FIG. 4 is a cross-sectional view taken on line 4—4 of FIG. 3.

FIG. 4 is a view of the interior of the non-rotatable structure 18 showing the locations thereon of the brushes 26–32 which are arranged in opposed pairs with the pair formed of brushes 26 and 30 positioned to engage the outer slip ring 34 and the pair formed of brushes 28 and 32 positioned to engage the inner slip ring 36. If additional brushes and slip rings are needed for other purposes, as indicated, there is plenty of room for them. The assembly 18 is shown having spaced torque resisting leg portions 160 and 162 which are attached to a non-rotatable structure 164 to prevent the assembly from rotating but do not provide support for the drive train 10. Leads 166 and 168 which are in the cable 24 are connected to the brushes 26–32 as in the manner shown, and a ground lead may also be provided, if necessary. Also, the assembly 18 houses the bearing assembly 20 which may include a ring of cylindrical bearing members positioned to engage annular bearing surface 170 (FIG. 2) formed on the outer surface of the input member 14.

Figure 5:
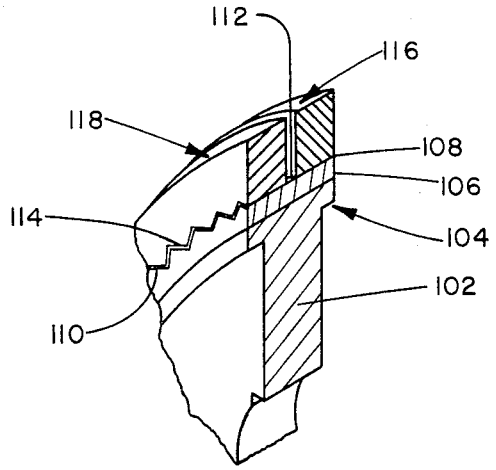
FIG. 5 is a fragmentary perspective view in cross-section of the gear reducer included as a portion of the drive chain shown in FIG. 3.

FIG. 5 is a fragmentary cross-sectional view through the speed reducer assembly 103 housed in the member 54 to better illustrate the construction thereof including the construction of the eccentric cam portion 104 of the member 102, and the manner in which it engages and slides on the flexible gear member 106 at opposite sides thereof forcing it into an oval shape so that its gear portions 108 and 110 engage the gears 112 and 114 on the members 116 and 118 at spaced opposite locations only thereby to enable the members 116 and 118 to rotate relative to each other during rotation of the member 102 to produce the desired speed and direction of rotation of the output portion 126 and 131 of the member 122, and hence also of the feed rod 144 and the pinion gear 148, as aforesaid.

Figure 6:
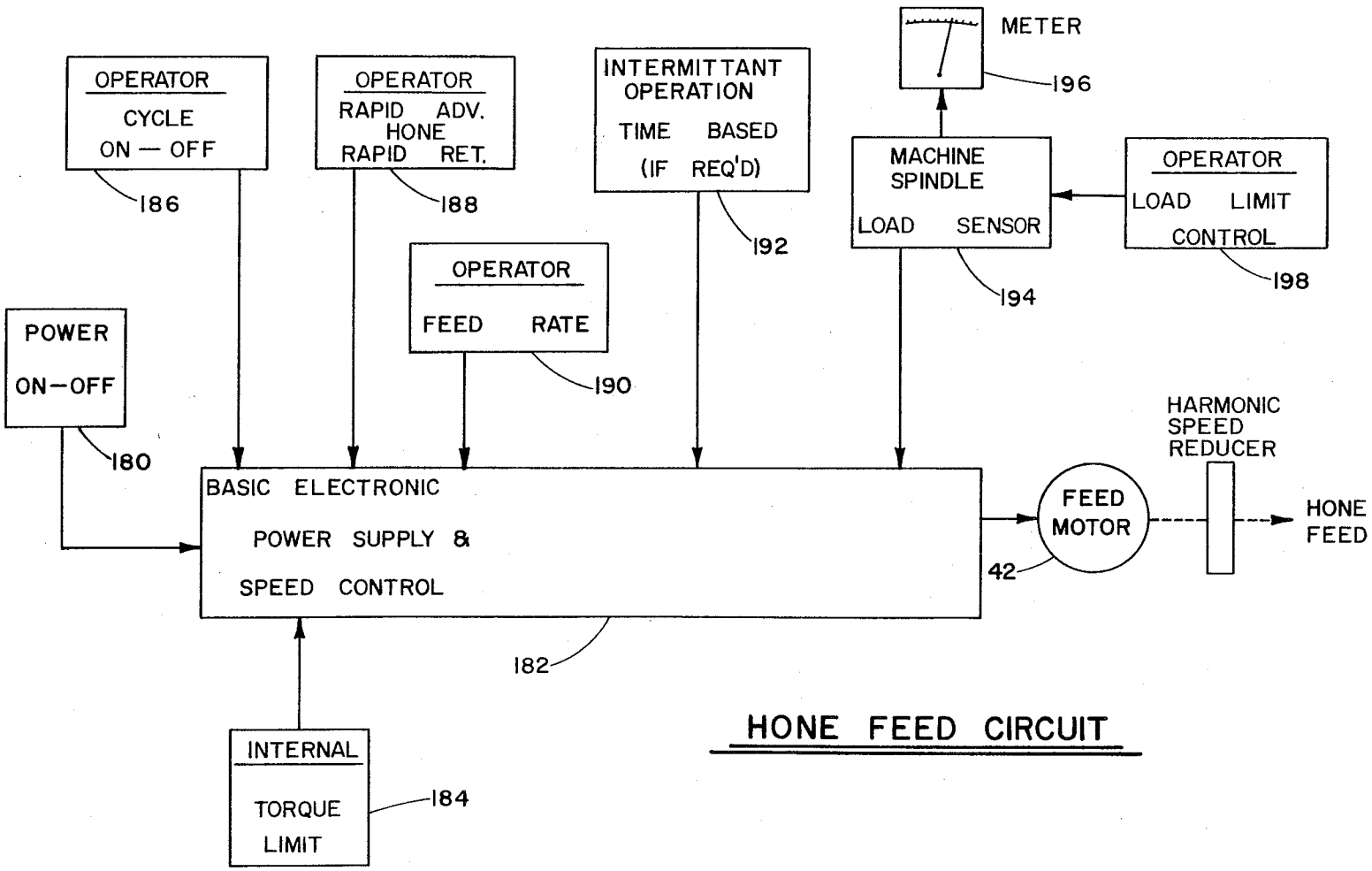
FIG. 6 is a block diagram of a control circuit for the motor means included in an embodiment shown in FIGS. 1–3.

In order to control the energy applied to the feed motor 42, including its magnitude and polarity, it is necessary to understand the construction and operation of the control circuit which supplies the energy thereto through the slip rings 34 and 36 and the brushes 26–32. A block diagram of the control circuit is shown in FIG. 6 and includes a power on-off control device or switch 180. The on-off control 180 is connected to an electronics package that includes power supply and feed control circuits all included in block 182. The electronics package 182 is controlled by several different elements including an internal torque limiting device 184 which limits the maximum amount of force or torque the system can deliver. If the torque or power required to rotate the drive train 10 exceeds some predetermined amount as detected by a load sensor in block 194, circuit means will operate to disable the block 182 and temporarily halt rotation of the motor 42. The amount of torque required to cause this to happen can be preset into the circuit by an operator adjustable load limit control 198 which can be set as desired depending upon the type of machine involved and the amount of permissable torque that can be applied by the work engaging elements against the work surface such as against a work surface being honed. This will vary with the characteristics of the work and with the type of work engaging elements or stones being used.

The control circuit also includes an operator cycle on-off control 186 which enables the operator to cycle the motor in the on position thereof. The electronics in block 182 are also controlled by an operator actuatable control which may be in the form of a switch or potentiometer included in circuit block 188 and used to cause the circuit in the block 182 to energize the motor 42 in a desired direction, usually to rapidly advance or rapidly retract the work engaging assemblies. This control is used to bring the work engaging assemblies relatively rapidly into contact with the work at the beginning of an operation thereby saving time and preventing the work engaging assembly from commencing an operation before all of the work engaging assemblies are engaged under pressure with the work surface. This control also enables the work engaging elements to be retracted rapidly as at the conclusion an the operation when the mandrel or work engaging assembly is to be removed from work in order to prevent damage to the work surface which might occur were a tight fitting assembly to be withdrawn. The control provided by the block 188 therefore saves time by speeding up the operation, increases the amount of work that can be done in a given period of time and substantially reduces damage to the tool and to the workpiece surface operated on.

Another circuit control is provided by block 190 which includes means to adjust the feed rate or rate of expansion of the work engaging assemblies on the tool or mandrel 12 during operation. The desired feed rate will depend on the characteristics of the workpiece and the type of tool being used such as the type of honing stones or other work engaging elements employed. The feed-up rate usually also takes into account the optimum load that should be applied to the work engaging elements or stones to produce the most desirable operating pressure. A feed-up rate that is too high may cause damage to the work engaging elements and to the work surface being operated on or honed, and a feed-up rate that is too low may cause the work engaging elements such as honing stones to glaze which is usually also an undesirable condition. When the subject invention is applied to a honing device using vitrified abrasive members or stones an ideal honing pressure usually occurs when sufficient force is applied by the honing stones against the work surface so that some continuous wearing away and crumbling of the stones takes place as the honing operation proceeds. If harder, more wear resistant, abrasives are used, different honing pressures may be preferred and the same will be true if the invention is applied to control operations other than honing operations as will be explained in connection with FIGS. 8, 9, 10 and 11.

The electronics included in the control device 182 has their output applied to the feed motor 42 under control of several other circuit conditions as will be explained. For example, the outputs of the circuit 182 can be controlled by intermittent operation control 192, an optional feature, which enables the output of the control 182 to be applied intermittently to the motor 42. The frequency and duration of application of energy to the feed motor 42 can also be varied by the means included in the block 192. The ability of the circuits in the block 182 to supply energy to the feed motor 42 is also subject to load limit means which include a load limit sensor 194 responsive to the load or torque applied to the machine input spindle 14 from the main drive source. Alternatively, a sensor responsive to the velocity (tachometer) or angular position of the shaft of motor 42 can be provided to influence the output of block 182. Data as to the torque being used can be displayed to the machine operator on meter 196 positioned at a convenient location. The indication of spindle load is also an instantaneous indication as to differences in the diameter of the workpiece surface being operated on. When the device is in a relatively small inside diameter of the workpiece surface a tight condition of the tool will occur and the torque on the drive train will therefore increase. As the diameter of the workpiece surface increases the torque will decrease. Thus the indicator or meter 196 which responds to torque, is also a straightness indicator that can be used in the control mode as a means to straighten out a bore that has different diameter portions and this can be done with less effort and with less total stock removal.

The operator is also provided with other means included in block 198 which enable him to set in a desired amount of maximum load or a load limit. For example, the operator can adjust the means 198 to a condition whereby the load is limited to some predetermined maximum horsepower or torque, and if the load on the mandrel 12 exceeds the preset limit as sensed by the load sensor 194, an output will be produced to prevent or modify the amount of power being applied to the tool by the feed motor 42 until the load sensed falls below the established limit. In other words, the tool pressure will remain substantially constant under these circumstances until sufficient material has been removed from the work surface or sufficient stone or tool wear has occurred, or both, for the torque to fall below the preset limit. When this occurs energy will again be able to be applied from the control block 182 to the feed motor 42 to radially advance the work engaging members on the work engaging assembly. As explained above, when the feed motor 42 is energized it operates either directly or through the speed reducer 103 to control the direction and speed of rotation of the pinion gear 148 which engages and controls the direction and speed of radial movement of the various work engaging members or assemblies engaged therewith.

Figure 7:
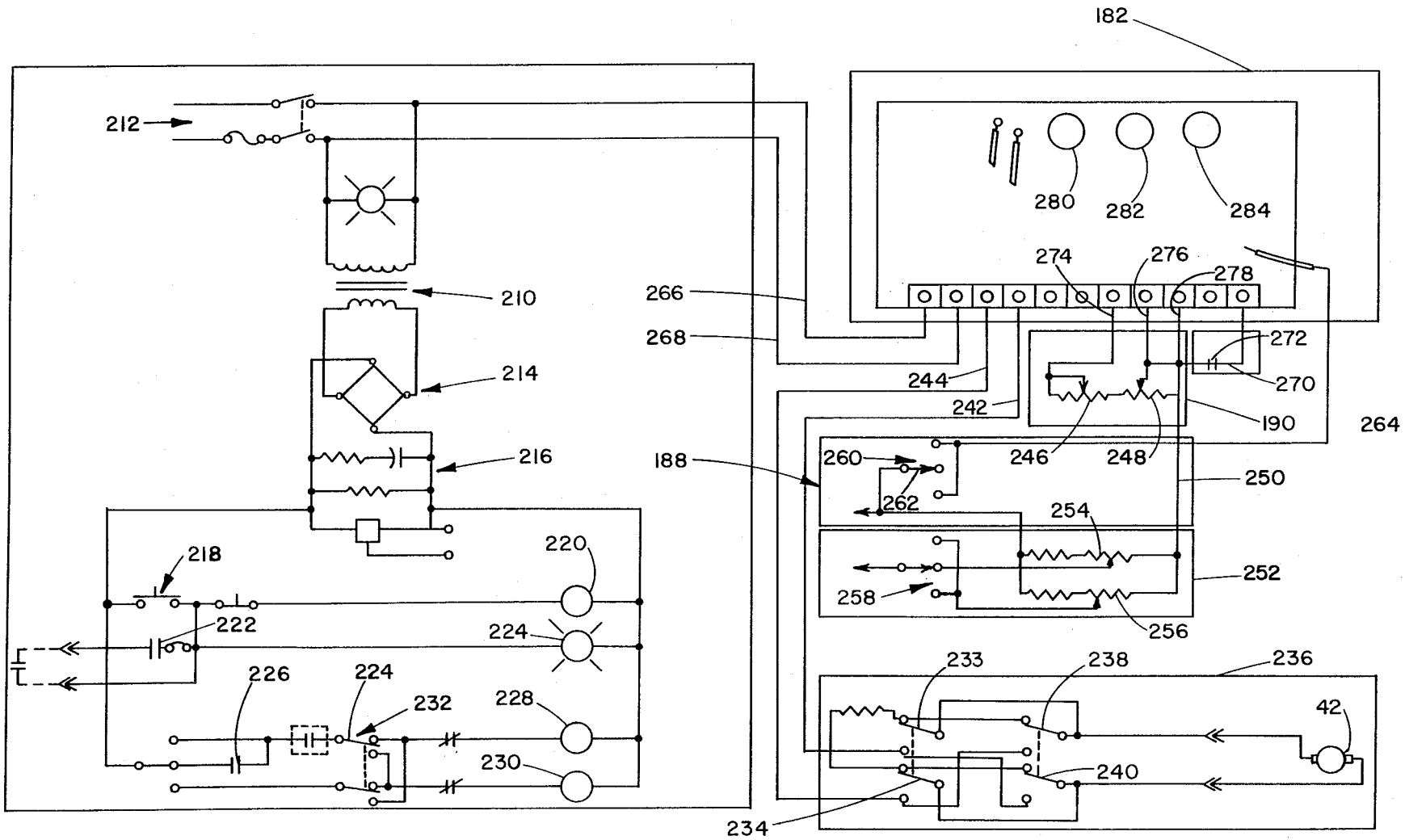
FIG. 7 is a schematic diagram of the circuit of FIG. 6.

FIG. 7 shows more details of the circuitry for the subject device. The power supply portion of the circuit includes input transformer 210 whose primary is connected to a source of energy 212 and whose secondary is connected to a full wave rectifier circuit 214 and to filter circuit 216. The output of the filter circuit 216 is connected across a circuit that includes start switch 218 in series with start/stop relay coil 220. The relay coil 220, when energized, closes its normally open contacts 222 in series with feed on lamp 224 to give notice of the fact that the circuit is on.

The relay coil 220 has other normally open contacts 226 which close when the coil is energized to establish a circuit to a selected one of an advance or retract relay coils 228 or 230 under control of a dual contact toggle switch 232. When the switch 232 is in one position the advance relay coil 228 will be energized and when in its other position the retract relay coil 230 will be energized.

The advance relay coil 228 controls ganged relay contact 233 and 234 in a brake and direction of rotation control circuit 236, and the retract relay coil 230 controls other ganged relay contacts 238 and 240 in the same direction of rotation control circuit. When the advance relay contacts 233 and 234 are moved to their transferred positions by energizing the relay coil 228 a circuit will be available from outputs 242 and 244 of the control circuit portion 182 to energize the feed motor 42 for rotation in one direction. This circuit is from the output lead 242 to and through the normally open side of the relay contact 233, to one side of the motor 42, and from the opposite side of the motor 42 back through the normally open side of the relay contact 234 to the lead 244.

In similar manner when the retract relay coil 230 is energized the connections from the leads 242 and 244 to the motor 42 are reversed through the relay contacts 238 and 240 so that the motor 42 will rotate in the opposite direction to retract rather than expand the working diameter of the work engaging assembly or mandrel. It is also contemplated to use an A-C motor in which case a phase change rather than a polarity change would be necessary to reverse the direction of motor rotation.

The feed rate control 190 includes potentiometers 246 and 248 which are connected to the circuit controller 182 as shown. The potentiometer 246 is used to adjust the maximum possible feed rate and the potentiometer 248 is used to establish the desire feed rate. The control 190 has a connection on lead 250 to a circuit portion 252 which is the force control circuit. This circuit includes other potentiometers 254 and 256 which have connections to two three position switches 258 and 260 as shown. The switch 260 is in the rapid advance/retract circuit 188 and includes a movable switch contact 262 that is connected to the potentiometers 254 and 256. The switch 260 has two stationary contacts which are connected by lead 264 to means in the control circuit 182.

The control circuit 182, which includes speed control circuitry, has other components and connections including AC input connections 266 and 268 which connect it to the input power source 212, connection 270 which connects it to one side of normally open relay contact 272 controlled by the start/stop relay coil 220, and other connections 274, 276, and 278 which connect it to the feed rate control circuit 190 described above. The circuit portion 182 also has resistors or potentiometers 280, 282, and 284 which respectively are a feed rate compensation adjustment that is used to adjust the I.R. losses in the feed motor, a minimum speed adjustment, and a maximum speed adjustment.

The present honing device and the control circuit associated therewith offer important advantages over what is available on the market as set forth above. The present device is also relatively easy to repair and maintain, the controls are simple and straight forward, and the subject device and controls lend themselves to accurate tool control and hence to accurate operation such as accurate honing, including the accurate honing of relatively long bores.

Additional circuitry may be added to the control to monitor motor speed or angular position using that information to control the operation of the feed motor and/or the host machine. This permits feeding to predetermined points at a predetermined rate and return to a preset point at the same or at a different rate. Any or all of the control elements discussed herein also lend themselves to being combined in an automatic sequence and operable under conditions of minimal operator attention including being adaptable to being controlled by a microprocessor or like device.

Figure 8:
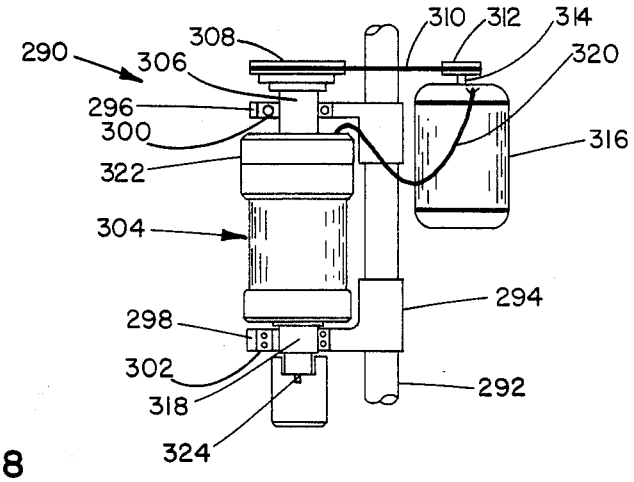
FIG. 8 is a side view, partly in section, showing another tool embodiment that can be controlled by means constructed according to the teachings of the present invention.

FIG. 8 shows another embodiment 290 in which the subject device is used to adjust a work engaging assembly such as a honing mandrel, a boring tool including a profiling boring tool, a roller forming tool or other similar device. The embodiment 290 is shown supported in a vertical orientation on a vertical support member 292 and includes a support bracket 294 which has spaced arm portions 296 and 298 which extend outwardly therefrom. The bracket 294 can be adjusted to different positions on the support 292. The arms 296 and 298 have bearing assemblies 300 and 302 positioned therein for rotatably supporting a rotatable structure 304. The rotatable structure 304 includes an upper shaft portion 306 to which is attached a multi-position pulley 308 which is coupled by belt 310 to a motor pulley 312 which may also be a multi-position pulley. The motor pulley 312 is mounted on a motor shaft 314 of a main drive motor 316 which provides the force necessary to rotate the entire structure 304 including the upper shaft portion 306, a lower shaft portion 318 and the work engaging portions of the tool. The rotatable structure 304 forms the housing for a feed motor such as the feed motor 42 described above, and the power for energizing the feed motor is provided on leads 320 which are connected to a non-rotatable member 322 which is journaled to the shaft 306 in the manner described above for the non-rotatable brush assembly 18. The non-rotatable member 322 is not a load carrying member and is included solely for the purpose of supplying energy to the feed motor as in the above structure. The rotatable structure 304 may optionally include a speed reducer device such as the speed reducer 103 described in connection with FIGS. 3 and 5, or the feed motor shaft may be connected more directly to drive a member such as a threaded or other adjustment means such, for example, as the adjustment member 324 shown in FIG. 8. The member 324 may be similar to the threaded adjustment member shown in Sunnen Pat. No. 3,378,962. The construction 290 shown in FIG. 8 may be operated in a vertical or in any other orientation and does not need or require either speed reducer means or universal connection means such as are shown in the construction described above. The construction 290 provides a relatively simple, effective and accurately controllable means for expanding, contracting and loading a tool such as a tool that works on an internal surface of a workpiece. This can include a honing mandrel, an internal boring tool, a roller forming tool or any other tool where the work engaging members must be able to be expandable and contractable into and out of engagement with a work surface.

Figure 9:
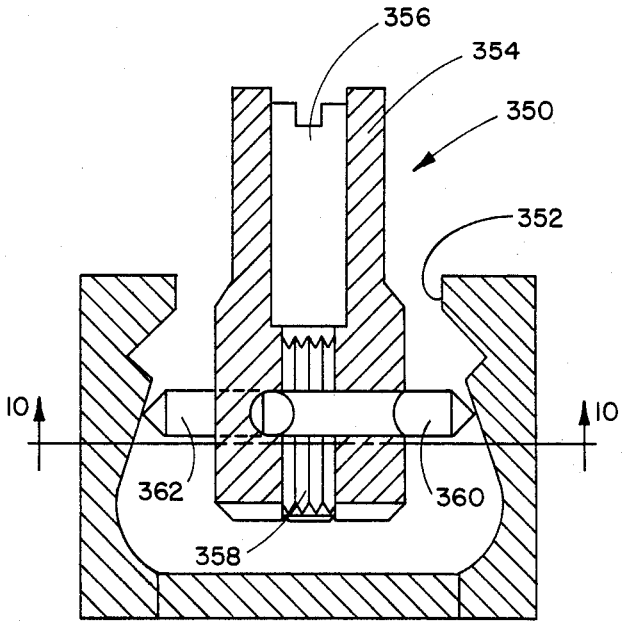
FIG. 9 is an enlarged cross-sectional view showing a tool for use in forming a profile on an internal bore surface, said tool being controllable by means constructed according to the present invention.

FIG. 9 shows a double tip boring tool 350 for profiling the inner surface of a bore such as bore 352. The tool includes a rotatable structure 354 which is driven by a main power source such as described above, and it has a rotatable member 356 mounted therein. The member 356 is connected or coupled to a feed motor such as to the feed motor 42 described above, and the rotatable member 356 is rotatable relative to the rotatable structure 354 during operation of the device. The rotatable member 356 has a pinion gear portion 358 which is shown engaging the teeth on a pair of opposed elongated single point tool members 360 and 362 which move radially when the pinion 358 rotates to engage the bore 352. The positions of the tools 360 and 362 can be programmed in a well known manner to produce the desired final contour for the surface of the bore 352, including producing a bore contour such as shown that may have portions of different diameter. The same tools can have their work engaging points shaped to produce work engaging tips on the sides as well as on the forward portions thereof so that they can be expanded radially outwardly when they emerge from the ends of the bore 352 to shape the adjacent end surfaces of the workpiece. This can be done with the same tool controls.

Figure 10:
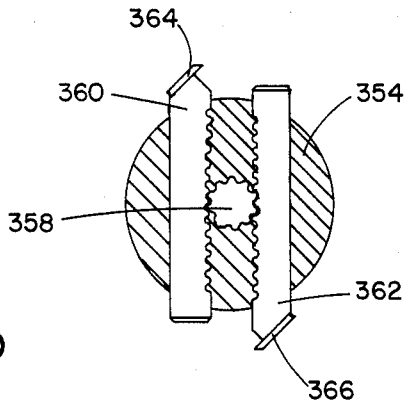
FIG. 10 is an enlarged cross-sectional view taken on line 10—10 of FIG. 9.

FIG. 10 is a cross-sectional view showing a typical arrangement for the work engaging members 360 and 362, each of which has a hard pointed cutting tool 364 and 366 respectively attached thereto.

Figure 11:
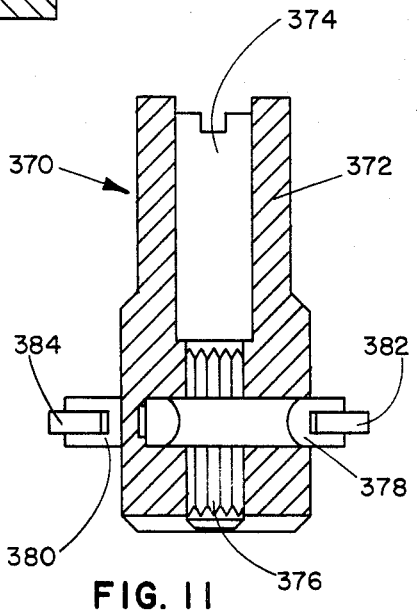
FIG. 11 is a an enlarged side view, partly in section of a roller forming tool controllable by the subject means.

FIG. 11 shows yet another tool embodiment 370 that can be operated by the present control means including having a rotatable structure with a feed motor mounted therein. The tool 370 is a roller forming tool and includes a rotating body portion 372 in which is positioned a rotatable member 374 that is rotated by a rotating feed motor such as the feed motor 42. The member 374 has a pinion gear portion 376 which cooperatively engages teeth formed on opposed radially movable roller assemblies 378 and 380 each of which has a respective roller 382 and 384 rotatably mounted thereon. When the tool 370 is positioned extending into a member such as into a tubular member formed of a material such as copper, aluminum or other like material, the rollers 382 and 384 will be adjusted outwardly to bear against the inner surface of the tube to apply outward force thereagainst to expand the tube thereat.

There are many other tools and devices to which the subject invention can also be applied. The important thing is that the present invention teaches the construction of a rotatable device that has a feed motor mounted therein, which feed motor is energizeable from an energy source such as described, through the use of slip rings and brushes, to cause the feed motor to rotate in a desired direction and at a desired feed rate for the purpose intended. This is done to make an adjustment of the work engaging portions of a tool or other device. With the present construction, unlike prior art constructions, the rotating feed motor is relatively unaffected by the rotation of the main drive chain in which it is positioned. This is not true of devices such as planetary gear arrangements which produce substantial inertia that effects the operation of the gears in the gear train to different extents for different directions of adjustment. This is an important distinction and one which enables the present device to be very accurately controllable both in the expansion and contraction directions. The present device also enables more accurate loading of the work engaging members because it does not have to operate through many gears in a gear chain.

Thus there has been shown and described an improved feed control means for controlling the expansion, contraction and loading of devices such as machine tools including honing devices, which fulfill all of the objects and advantages sought therefor. It will be apparent to those skilled in the art, however, that many changes, modifications, variations, and other uses and applications for the subject device are possible, and all such changes, modifications, variations, and other uses and applications which do not depart from the spirit and scope of the invention are deemed to be covered by the invention which is limited only by the claims which follow.

What is claimed is:

1. A rotary drive train for a radially expandable tool comprising:

a machine tool, rotatable about an axis which is substantially coaxial with the rotational axis of the drive train connected thereto including a body having a longitudinal bore therethrough and at least two angularly related transverse bores intersecting the longitudinal bore at an intermediate location therealong, an adjustment member positioned in the longitudinal bore substantially on the rotational axis of the machine tool, at least two opposed work engaging assemblies having means extendible into selected ones of the transverse bores for engaging the adjustment member whereby movements of the adjustment member in the longitudinal bore produces radial movement of the work engaging assemblies, a non-rotatable structure, said rotary drive train including a rotatable drive operatively connected to the machine tool and rotatable relative to the non-rotatable structure to rotate the machine tool, said rotatable drive including a rotatable motor housing, a feed motor, having a motor shaft mounted in the motor housing substantially on the rotational axis of the drive train and rotatable therewith and means to supply electric energy to the feed motor including slideably engageable first and second contact means positioned respectively on the rotatable drive train and on the non-rotatable structure, and means operatively connecting the motor shaft to the adjustment member.

2. The rotary drive train of claim 1 including control circuit means for supplying electric energy to the feed motor, said control circuit including means operable to select the polarity of the energy supplied to the feed motor to control the direction of rotation thereof.

3. The rotary drive train of claim 2 wherein the control circuit means include means to adjust the magnitude of the energy supplied to the feed motor to control the speed of rotation of the feed motor shaft.

4. The rotary drive train of claim 1 including means responsive to the torque applied by the machine tool against a work surface being operated on thereby including means to change the energy being supplied to the feed motor when the torque exceeds some predetermined maximum torque.

5. The rotary drive train of claim 1 wherein the means operatively connecting the motor shaft to the adjustment member include universal connection means.

6. The rotary drive train of claim 1 wherein the means operatively connecting the motor shaft to the adjustment member include an harmonic speed reducer.

7. The rotary drive train of claim 1 wherein the means connecting the rotatable drive to the machine tool include universal connection means.

8. The rotary drive train of claim 1 wherein the means connecting the rotatable drive to the machine tool include an elongated tubular member having a respective universal connection at each opposite end thereof, and wherein the means operatively connecting the motor shaft to the adjustment member include a rod extending through the tubular member, said rod having a universal connection at each opposite end thereof and located inwardly respectively of the universal connections at the respective opposite ends of the tubular member.

9. The rotary drive train of claim 2 wherein the control circuit means include operator actuatable means selectively actuatable to rotate the feed motor shaft in a desired direction and at a desired speed to change the radial positions of the work engaging assemblies on the body of the machine tool.

10. The rotary drive train of claim 1 wherein the machine tool is a honing mandrel with said plurality of radially movable work engaging assemblies containing honing elements.

11. The rotary drive train of claim 1 wherein the machine tool is a boring tool with said plurality of radially movable assemblies containing honing elements.

12. The rotary drive train of claim 1 wherein the machine tool is a roller forming tool with said plurality of radially movable assemblies containing roller elements.

13. The rotary drive train of claim 2 wherein the control circuit means include load sensing means and means to prevent energy from being applied to the feed motor when the load exceeds some predetermined load.

14. The rotary drive train of claim 2 wherein the control circuit means include means to produce intermittent operation of the feed motor.

15. The rotary drive train of claim 1 including means to program the position of the work engaging assemblies on the body, said means including means to modify the energy supplied to the feed motor.

16. Means to control the radial positions of work engaging assemblies on a rotatable member comprising a body with a plurality of radially movable work engaging assemblies mounted thereon, said body having a longitudinal bore extending therethrough, a pinion gear mounted for rotational movement in said bore, a plurality of transverse bores intersecting the longitudinal bore at angularly spaced locations and said plurality of work engaging assemblies each having rack gear means thereon extendible into respective ones of the transverse body bores for engagement with the pinion gear to allow for radial adjustment of said work engaging assemblies, means to rotate the body about an axis of rotation including a rotary drive train having an input operatively connected to a source of rotating energy, and an output operatively connected to the body, said rotary drive train including a housing portion rotatable with the body and a feed motor positioned in the housing portion at a location substantially on the axis or rotation of the body to rotate therewith, a non-rotatable member positioned adjacent to the rotary drive train having connections thereon to a source of electrical energy, and connection means on the rotary drive train making slideable electrical connections between the connections on the non-rotatable member to supply energy to the feed motor from the electric energy source, said feed motor having an output shaft, aligned substantially with the axis of rotation of the honing portion operatively connected to the pinion gear for rotation thereof.

17. The means of claim 16 wherein the connection means making slideable electric connection include brushes and slip rings operatively connected between the drive train and to the non-rotatable member.

18. The means of claim 16 including a control circuit having an input operatively connected to a source of energy and an output operatively connected to the feed motor through the slideable electrical connection means, said control circuit including means to control the speed and direction of rotation of the feed motor.

19. The means of claim 16 including sensor means responsive to the torque on the rotatable member, and means to de-energize the feed motor whenever the torque sensed by the sensor means exceeds some preset torque.

20. The means of claim 16 including sensor means responsive to the speed of the feed motor, including means to modify the energy supplied thereto.

21. The means of claim 16 including sensor means responsive to the angular position of the feed motor, including means to modify the energy supplied thereto.

22. A rotary drive train for a radially expandable hone comprising:

a honing mandrel including a body having a longitudinal bore extending therethrough and at least two spaced and substantially opposed work engaging assemblies each having rack gear means thereon engageable with the pinion gear such that rotation of the pinion gear produces radial movement of the working engaging assemblies on the body, a non-rotatable structure, said rotary drive train including a rotatable drive connection operatively connected to the honing mandrel and rotatable relative to the non-rotatable structure to rotate the honing mandrel, said rotatable drive connection including a motor housing and means connecting the motor housing to the housing and means connecting the motor housing to the honing mandrel for rotation therewith about an axis of rotation a feed motor, having a feed motor shaft, mounted in the motor housing for rotation therewith, said feed motor being located substantially on the axis of rotation of the motor housing and means to supply controlled electric energy to the feed motor including slideably engageable contact means having portions positioned on the rotatable drive connection and portions positioned on the non-rotatable structure, and means operatively connecting the feed motor shaft to the pinion gear to produce rotation thereof relative to the body portion of the honing mandrel.

23. The rotary drive train of claim 22 including control circuit means for supplying controlled electric energy to the feed motor, said control circuit including means operable to select the polarity of the energy supplied to the feed motor to control the direction of rotation thereof.

24. The rotary drive train of claim 23 wherein the control circuit means include means adjustable to establish the magnitude of the electric energy supplied to the feed motor to control the speed of rotation of the feed motor shaft.

25. The rotary drive train of claim 22 including means responsive to the torque applied by the machine tool against a work surface being operated on thereby including means to vary the energy supplied to the feed motor in response to the torque.

26. The rotary drive train of claim 22 wherein the means operatively connecting the feed motor shaft to the pinion gear include universal connection means.

27. The rotary drive train of claim 22 wherein the means operatively connecting the feed motor shaft to the pinion gear include an harmonic speed reducer.

28. The rotary drive train of claim 22 wherein the means connecting the motor housing to the machine tool include universal connection means.

29. The rotary drive train of claim 22 wherein the means connecting the motor housing to the machine tool includes an elongated tubular member having a universal connection at each opposite end thereof, and wherein the means operatively connecting the feed motor shaft to the pin ion gear includes a rod extending through the tubular member, said rod having a universal connection at each opposite end thereof located inwardly respectively of the universal connections at opposite ends of the tubular member.

30. The rotary drive train of claim 23 wherein the control circuit includes means actuable by an operator to control the direction of rotation of the feed motor shaft and the speed of rotation thereof.

31. Means to control the radial positions of work engaging assemblies on a rotatable member comprising a body with a plurality of angularly related radially movable work engaging assemblies mounted thereon, said body having a longitudinal bore extending therethrough, an adjustment member positioned in said bore, transverse bores intersecting the longitudinal bore and a plurality of work engaging assemblies each having a portion extendible into respective ones of the transverse body bores for engagement with the adjustment member whereby movement of the adjustment member produces radial movements of the work engaging assemblies, means to rotate the body about an axis of rotation including a rotary drive train having an input operatively connected to a source or rotating energy and an output operatively connected to the body to rotate the body in concert therewith, said rotary drive train including a housing portion rotatable with said body and a feed motor positioned in the housing portion substantially on the axis of rotation of the body to rotate therewith, a non-rotatable member positioned adjacent to the rotatable drive train, a drive connection having opposite ends connected respectively to the rotatable housing portion and to the body to form parts of the drive train, said feeder motor having input electrical connections and an output shaft located substantially on the axis of rotation of the body, said input electrical connections including slideable connection means having a portion mounted on the rotatable drive train and a portion mounted on the non-rotatable member, and a feed rod extending through the drive connection having opposite ends operatively connected respectively to the motor shaft and to the adjustment member.

32. The means of claim 31 wherein an harmonic speed reducer is operatively connected between the motor shaft and the adjustment member.

33. The means of claim 31 wherein slideable connection means include brushes and slip rings operatively connected between the housing portion and the non-rotatable member.

34. The means of claim 31 including a control circuit having an input operatively connected to a source of energy and an output operatively connected to the feed motor through the slideable electrical connection means, said control circuit including means to control the speed and direction of rotation of the feed motor output shaft.

35. The means of claim 31 including sensor means responsive to the torque on the rotatable member, and means to de-energize the feed motor whenever the torque sensed by the sensor means exceeds some preset maximum torque.

36. A differential motion generator comprising a rotatable structure having an input end portion and an output end portion, said rotatable structure being rotatable about an axis of rotation, means connected to the input end portion to rotate the rotatable structure, means connected to the output end portion including a work engaging assembly having a body portion with a bore therethrough, an adjustment member mounted in said bore, and at least two angularly related work engaging assemblies each having a portion engageable with and radially movable by movements of the adjustment member to change the working diameter of the work engaging assembly, a feed motor, having a motor shaft, mounted in the rotatable structure for rotation therewith, said feed motor shaft being positioned to rotate substantially on the axis of rotation of the rotatable structure, means operatively connecting the motor shaft to the adjustment member, and means to energize the feed motor including a non-rotatable member mounted adjacent to the rotatable structure, first and second slideably engageable members mounted respectively on the rotatable structure and on the non-rotatable member, means connecting the first slideably engageable members to a source of electric energy and means connecting the second slideably engageable members to the feed motor.

37. The differential motion generator of claim 36 wherein the work engaging assembly is a honing mandrel.

* * * * *

UNITED STATES PATENT OFFICE

CERTIFICATE OF CORRECTION

Patent No. 4,512,116 Dated April 23, 1985

Inventor(s) Frank E. Vanderwal, Jr. & James K. Davis

It is certified that error appears in the above-identified patent and that said Letters Patent are hereby corrected as shown below:

Column 2, line 48 "througn" should be --- through ---.
Column 3, line 52 "contractaole" should be --- contractable --.
Column 15 line 44, delete "to the"; line 45, delete "housing and means connecting the motor housing".
Column 16, line 22, "pin ion" should be --- pinion ---; line 46, "or" should be --- of ---; line 58, "feeder" should be --- feed ---.

Signed and Sealed this

*Twenty-seventh* Day of *August 1985*

[SEAL]

*Attest:*

DONALD J. QUIGG

*Attesting Officer* *Acting Commissioner of Patents and Trademarks*